US009737902B2

(12) United States Patent
Ogata et al.

(10) Patent No.: US 9,737,902 B2
(45) Date of Patent: Aug. 22, 2017

(54) AEROSOL CONTAINER FIXING PLATE

(71) Applicant: TOYO AEROSOL INDUSTRY CO., LTD., Tokyo (JP)

(72) Inventors: Ken Ogata, Tokyo (JP); Hirokazu Shimizu, Tokyo (JP); Toru Toma, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 126 days.

(21) Appl. No.: 14/716,497

(22) Filed: May 19, 2015

(65) Prior Publication Data

US 2015/0251202 A1 Sep. 10, 2015

Related U.S. Application Data

(63) Continuation of application No. PCT/JP2013/080702, filed on Nov. 13, 2013.

(30) Foreign Application Priority Data

Apr. 3, 2013 (JP) ..... 2013-077931

(51) Int. Cl.
*B67D 7/78* (2010.01)
*B05B 11/00* (2006.01)
(Continued)

(52) U.S. Cl.
CPC ..... *B05B 11/0078* (2013.01); *B65D 83/206* (2013.01); *B65D 83/68* (2013.01); *B65D 83/40* (2013.01)

(58) Field of Classification Search
CPC ..... B05B 11/0078; B65D 83/14; B65D 83/20; B65D 83/206; B65D 83/68; B65D 83/40
(Continued)

(56) References Cited

U.S. PATENT DOCUMENTS 3,156,382 A * 11/1964 Michell ..... B65D 83/40 222/182
3,180,531 A * 4/1965 Beard, Jr. ..... B65D 83/205 222/182
(Continued)

FOREIGN PATENT DOCUMENTS

JP 60-041340 U 3/1985
JP 2002-193363 A 7/2002
(Continued)

OTHER PUBLICATIONS

International Search Report dated Feb. 18, 2014, issued in corresponding application No. PCT/JP2013/080702.
(Continued)

*Primary Examiner* — Patrick M Buechner
*Assistant Examiner* — Michael J Melaragno
(74) *Attorney, Agent, or Firm* — Westerman, Hattori, Daniels & Adrian, LLP

(57) ABSTRACT

The fixing plate for an aerosol container includes: an outer wall 12 that covers a mounting cup 4 except an opening 11 exposing two stems 6 and abuts on an upper face of an annular rim 5; a cylindrical wall 16 integrally connected to the outer wall 12 on a lower side thereof and surrounding the annular rim 5; and an engaging claw 16*a* engaging the annular rim 5, wherein a positioning wall 13 is provided at the opening 11, the positioning wall having an inner circumferential shape following an outer circumferential surface of a projection 7 that protrudes from the mounting cup 4, with the two stems 6 being bound together, and that has a non-circular cross-sectional shape with long sides and short sides.

6 Claims, 18 Drawing Sheets

B-B CROSS SECTION

(51) Int. Cl.
*B65D 83/20* (2006.01)
*B65D 83/68* (2006.01)
*B65D 83/40* (2006.01)

(58) Field of Classification Search
USPC ..... 222/141.1, 135, 402.13, 129, 182, 394
See application file for complete search history.

(56) References Cited

U.S. PATENT DOCUMENTS 3,333,744 A * 8/1967 Nilsen ..... A47J 43/128 222/402.13
3,946,912 A * 3/1976 Landsman ..... B65D 83/206 222/402.13
4,142,650 A * 3/1979 Almouli ..... B65D 83/386 222/135
4,773,562 A * 9/1988 Gueret ..... A45D 40/24 222/135
5,901,883 A * 5/1999 Ritsche ..... A61M 15/009 222/137
6,722,532 B2 * 4/2004 Lasserre ..... A45D 19/02 222/137
6,736,288 B1 * 5/2004 Green ..... B65D 83/62 222/145.6
7,854,350 B2 * 12/2010 Lasserre ..... B65D 83/68 222/135
8,925,765 B2 1/2015 Hanai et al.
D731,312 S * 6/2015 Shimizu ..... B65D 83/206 D9/439
9,475,636 B2 * 10/2016 Mekata ..... B65D 83/20
9,630,766 B2 * 4/2017 Ogata ..... B65D 83/206
2002/0074357 A1 * 6/2002 Karr ..... B65D 83/207 222/190
2002/0108972 A1 * 8/2002 Bayer ..... B65D 83/206 222/402.13
2004/0134931 A1 * 7/2004 Jinbo ..... B65D 83/68 222/145.6
2007/0045343 A1 * 3/2007 Lasserre ..... B65D 83/20 222/135
2007/0045344 A1 * 3/2007 Lasserre ..... B65D 83/20 222/135
2011/0226810 A1 * 9/2011 Wang ..... B05B 11/0027 222/129
2011/0226812 A1 * 9/2011 Wang ..... B05B 11/0027 222/145.1
2012/0168463 A1 * 7/2012 Hanai ..... B65D 83/62 222/135
2013/0112707 A1 * 5/2013 Hanai ..... B65D 83/38 222/94
2013/0119088 A1 * 5/2013 Hanai ..... B65D 83/34 222/135
2013/0161351 A1 * 6/2013 Eini ..... B01F 3/04446 222/135
2013/0175297 A1 * 7/2013 Sugimoto ..... B65D 83/206 222/135
2013/0270294 A1 * 10/2013 Shibata ..... B65D 83/48 222/94
2014/0197200 A1 * 7/2014 Hanai ..... B65D 83/62 222/95
2015/0251202 A1 * 9/2015 Ogata ..... B65D 83/206 239/418
2016/0023839 A1 * 1/2016 Ogata ..... B65D 83/206 222/402.13
2016/0075500 A1 * 3/2016 Ogata ..... B65D 83/206 220/315
2016/0083171 A1 * 3/2016 Ogata ..... B65D 83/206 222/149
2016/0083172 A1 * 3/2016 Ogata ..... B65D 83/206 222/394

FOREIGN PATENT DOCUMENTS

JP 2005-041510 A 2/2005
JP 2008-290755 A 12/2008
JP 2009-023684 A 2/2009
JP 2011-126575 A 6/2011
JP 2011-213400 A 10/2011
JP 2012-030886 A 2/2012
WO 9741964 A1 11/1997

OTHER PUBLICATIONS

Extended European Search Report dated Jan. 10, 2017, issued in counterpart application No. 13880991.8. (5 pages).

* cited by examiner

A-A CROSS SECTION

FIG. 3 B-B CROSS SECTION

Fig. 4 (a)
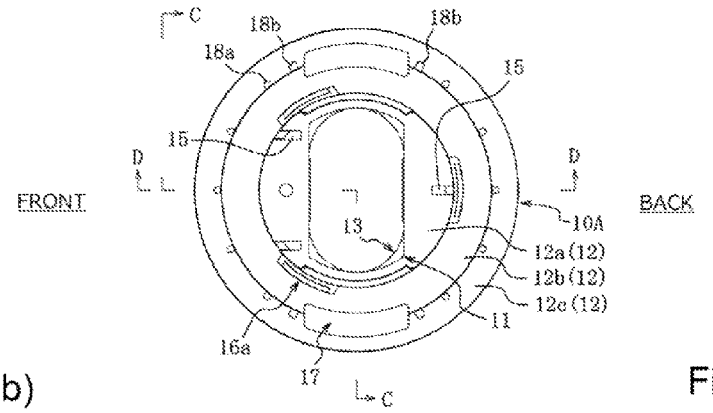
Fig. 4 (b)
Fig. 4 (c)
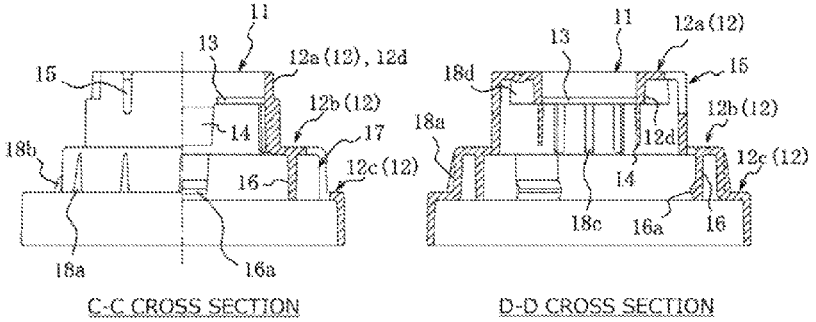
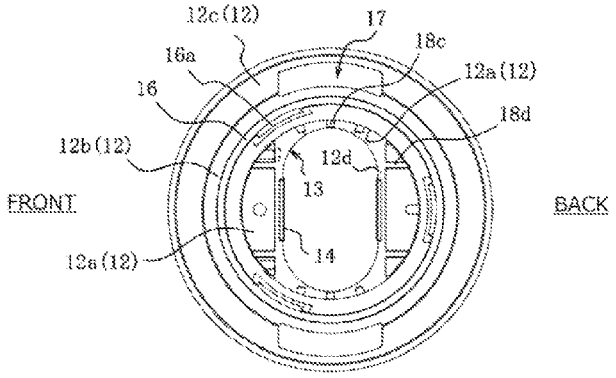
Fig. 4 (d)

AS VIEWED FROM ARROW G

H-H CROSS SECTION

I-I CROSS SECTION

AS VIEWED FROM ARROW J

AS VIEWED FROM ARROW K

L-L CROSS SECTION

M-M CROSS SECTION

AS VIEWED FROM ARROW P

AEROSOL CONTAINER FIXING PLATE

TECHNICAL FIELD

The present invention relates to an aerosol container fixing plate, mounted to an aerosol container to engage and hold a cover member covering a mounting cup of the container, and more particularly a fixing plate is mounted to an aerosol container containing two types of contents separately and having a total of two stems for dispensing the contents.

BACKGROUND ART

Regarding existing types of containers for two liquid type of hair dying or hair styling products or the like, a dual compartment aerosol container has hitherto been known (see, for example, Patent Document 1), which consists of a fixing plate that holds two cylindrical aerosol containers arranged side by side, a nozzle having two connection parts connected to the stems of respective aerosol containers for dispensing the contents held in respective containers from one discharge tube, and a cover member provided with an actuator part for pressing the nozzle. The pair of inner containers of such a dual compartment aerosol container as a whole have a cross section in the form of a race track, and the fixing plate and the cover member attached to the containers also have a race-track shape. Assembling of these parts is relatively easy work because they can be set in position only by checking their orientation in the front to back direction relative to the container.

PRIOR ART LITERATURE

Patent Documents

Patent Document 1: Japanese Patent Application Laid-open No. 2005-41510

SUMMARY OF THE INVENTION

Problems to be Solved by the Invention

Recently, the number of aerosol containers which can contain two types of contents separately in one container is increasing and so circular cross-sectional shaped containers are beginning to be used. It is also desired, for such containers, too, that parts be able to be mounted in an intended orientation reliably and easily, similarly to the conventional dual compartment aerosol containers. It is also desirable, for avoiding a cost increase as well as to improve the development efficiency, that the same fixing plate be used for various cover members that are desired to vary in type in accordance with the contents or users' preferences.

The present invention is directed to resolve this issue, an object thereof being to propose a novel fixing plate for an aerosol container, which can be mounted to an aerosol container with two stems reliably and easily, and allows attachment of various cover members.

Means for Solving the Problems

The present invention resides in an aerosol container fixing plate, mounted to an aerosol container having two stems to engage and hold a cover member covering a mounting cup of the container, the fixing plate including:

an outer wall that covers the mounting cup except an opening for exposing the two stems and abuts on an upper face of an annular rim of the mounting cup; a cylindrical wall integrally connected to the outer wall on a lower side thereof and surrounding the annular rim; and an engaging claw provided on an inner circumferential surface of the cylindrical wall to engage the annular rim thereby anchoring the fixing plate, wherein the outer wall includes a positioning wall having an inner circumferential shape following an outer circumferential surface of a projection that protrudes from the mounting cup, with the two stems being bound together, and that has a non-circular cross-sectional shape with long sides and short sides.

The inner circumferential shape of the positioning wall has preferably a rectangular, race-track, or elliptical shape.

The positioning wall is preferably to be provided with thin tongue members which should extend downward from long side edges thereof.

The outer wall preferably includes a pair of outer face ribs at positions sandwiching a pair of inner face ribs, which are provided on both sides of an engaging piece of the cover member.

The outer wall preferably includes a concave section or a convex section to be fitted with at least one convex section or one concave section provided in the cover member, used for attaching the cover member. In particular, the concave section or convex section of the outer wall is preferably provided in a front portion and a rear portion of the outer wall corresponding to the convex section or concave section of the cover member, and the number of the concave section or convex section provided in the front portion should be preferably different from that of the concave section or convex section provided in the rear portion.

Effects of the Invention

The fixing plate includes an outer wall that overlaps the mounting cup except in an opening for exposing the two stems and abuts on an upper face of an annular rim of the mounting cup; a cylindrical wall integrally connected to the outer wall on an underside thereof and surrounding the annular rim; and an engaging claw provided on an inner circumferential surface of the cylindrical wall to engage the annular rim, wherein a positioning wall is provided at the opening, the positioning wall having an inner circumferential shape conforming to an outer circumferential surface of a projection that protrudes from the mounting cup with the two stems bound together and that has a non-circular cross-sectional shape with long sides and short sides. Thus the fixing plate is effectively prevented from being misaligned relative to the container, and is anchored reliably. Rotation of the fixing plate relative to the aerosol container (rotation around the axis line of the container) can also be prevented.

If the inner circumferential shape of the positioning wall is one of rectangle, race-track shape, or ellipse, it can be formed without an increase in the production cost, as these shapes are simple.

With the tongues provided to the positioning wall such as to extend downward from the long side edges thereof, if the fixing plate and the aerosol container face each other, the fixing plate will be lowered to a height where the tips of the tongues abut on the lower end of the projection. If, however, they are misaligned with each other, the fixing plate will be located higher than the predetermined height because the tips of the tongues abut on the upper face of the projection. This way, whether they are aligned with each other or not can be determined based on the difference in height of the fixing plate. The assembling work is thus made even easier.

With a pair of outer face ribs provided to the outer wall at positions sandwiching a pair of inner face ribs, which are provided on both sides of an engaging piece of the cover member, an outward deformation in a collapsing manner of the cover member is prevented when the engaging piece is pressed in to remove the cover member, so that the cover member can be removed easily.

With a concave section or a convex section provided to the outer wall to be fitted with at least one convex section or one concave section provided to the cover member for attaching the cover member, inadvertent reverse attachment of the cover member to the fixing plate can be prevented. If, in particular, the concave section or convex section of the outer wall is provided in a front portion and a rear portion of the outer wall corresponding to the convex section or concave section of the cover member, and if the concave section or convex section is provided in a different number in the front portion from that of the concave section or convex section provided in the rear portion, the assembling work is made easy, because the front to back orientation of the cover member can be recognized by the difference in the number of the convex section or concave section.

BRIEF DESCRIPTION OF THE DRAWINGS

FIG. 4(*a*) is a plan view, FIG. 4(*b*) is a half cross-sectional view along C-C of FIG. 4(*a*), FIG. 4(*c*) is a cross-sectional view along D-D of FIG. 4(*a*), and FIG. 4(*d*) is a bottom view of the fixing plate shown in FIGS. 1(*a*) and 1(*b*);

EXPLANATION OF REFERENCE NUMERALS

Figure 1:
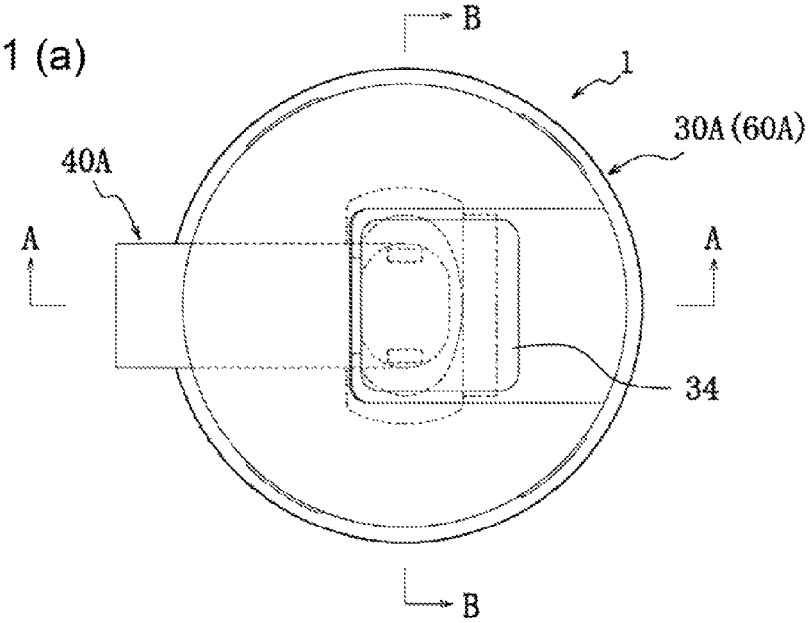
FIG. 1(*a*) is a plan view and FIG. 1(*b*) is a side view illustrating a first embodiment of the fixing plate for an aerosol container according to the present invention in a state in which it is mounted to the container.
Figure 1:
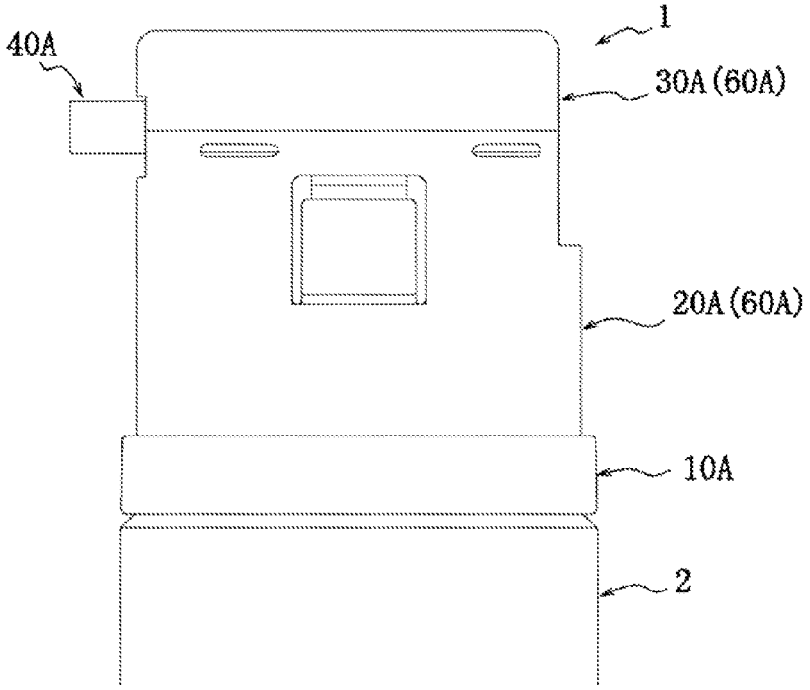

2: Aerosol container
4: Mounting cup
5: Annular rim
6: Stem
7: Projection
10A, 10B, 10B': Fixing plate
11: Opening
12: Outer wall
13: Positioning wall
14: Tongue
15: Concave section
16: Cylindrical wall
16*a*: Engaging claw
18*b*: Small rib (outer face rib)
20A: Lower cover (cover member)
25: First engaging piece
25*a*: Claw
27: Second engaging piece
30A: Upper cover (cover member)
33: Second engaging piece
33*a*: Pressure receiving portion
33*b*: Claw
40A, 40B, 40C: Nozzle
50A, 50B: Over cap
60A, 60B, 60C, 60C': Cover member
64B: Convex section
65B: First engaging piece (engaging piece)
65$B_1$: Claw
67B: Inner face rib

Modes For Carrying Out The Invention

Hereinafter, the present invention will be described in more detail with reference to the drawings.

Figure 2:
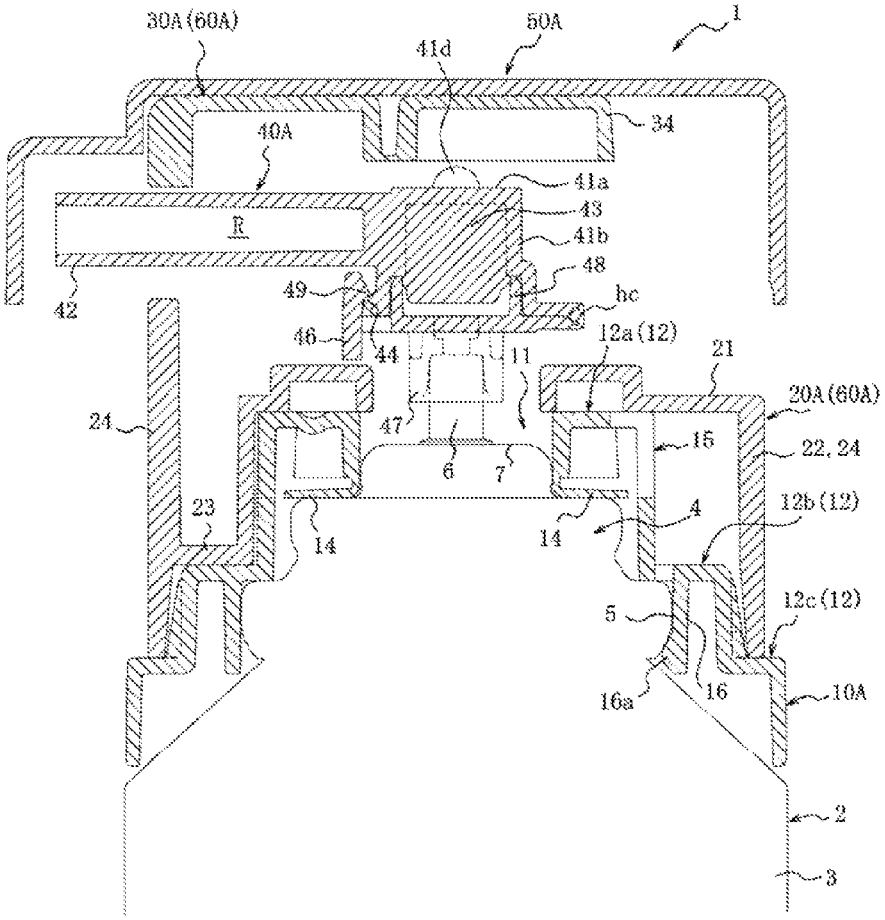
FIG. 2 is an enlarged cross-sectional view of major parts along A-A shown in FIG. 1(*a*), illustrating a state with an over cap further mounted in addition to the state of FIGS. 1(*a*) and 1(*b*)
Figure 3:
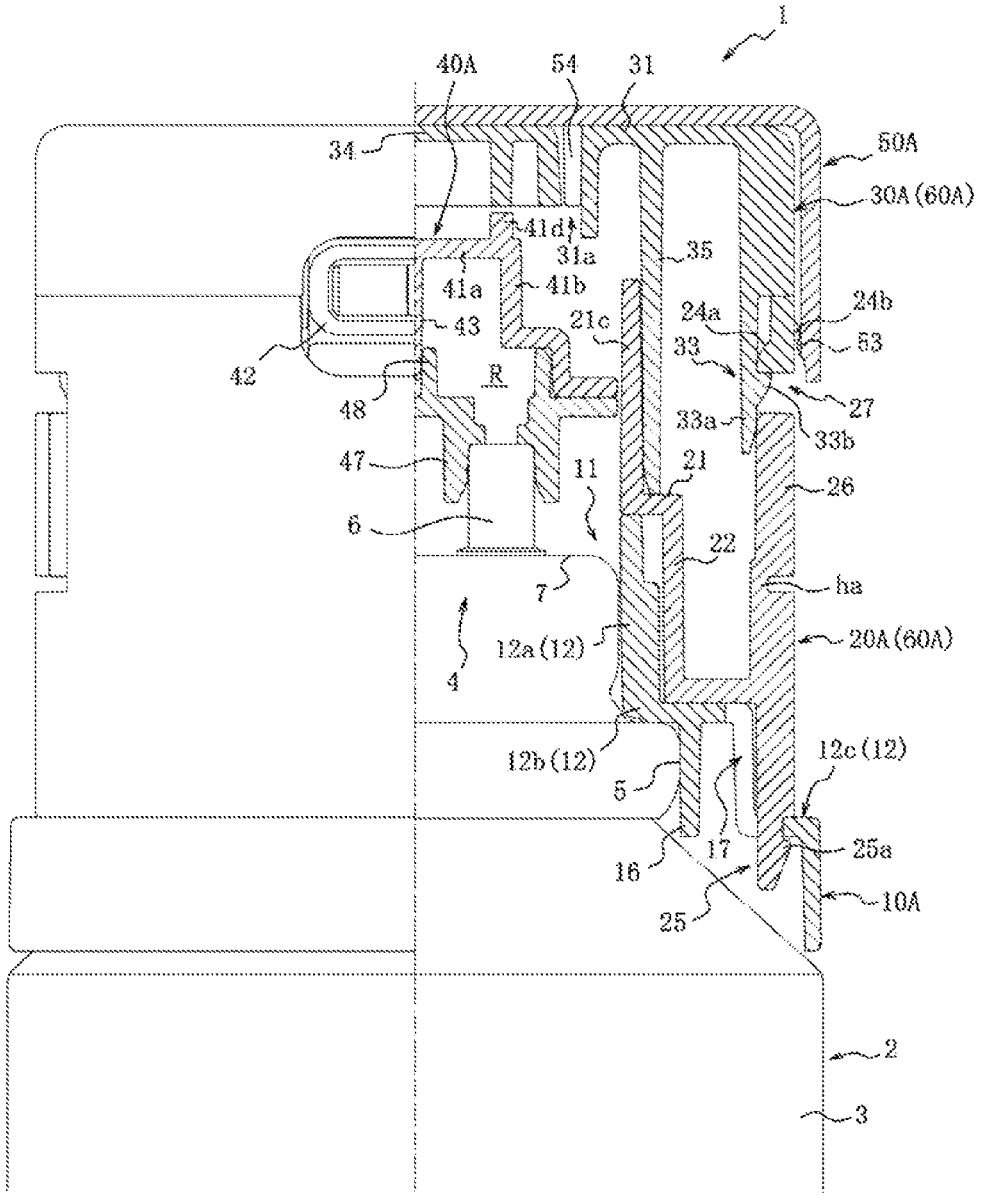
FIG. 3 is an enlarged half cross-sectional view of major parts along B-B shown in FIG. 1(*a*), illustrating a state with an over cap further mounted in addition to the state of FIGS. 1(*a*) and 1(*b*)
Figure 5:
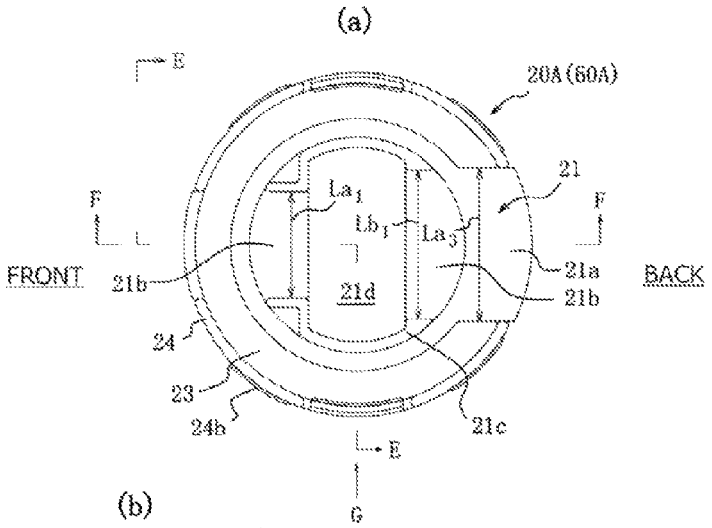
FIG. 5(*a*) is a plan view, FIG. 5(*b*) is a half cross-sectional view along E-E of FIG. 5(*a*), and FIG. 5(*c*) is a cross-sectional view along F-F of FIG. 5(*a*) of the lower cover shown in FIGS. 1(*a*) and 1(*b*)
Figure 5:
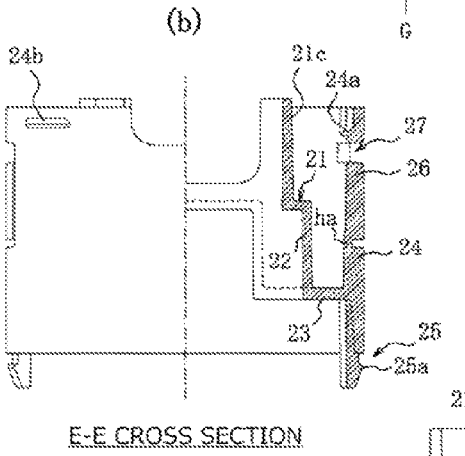
Figure 5:
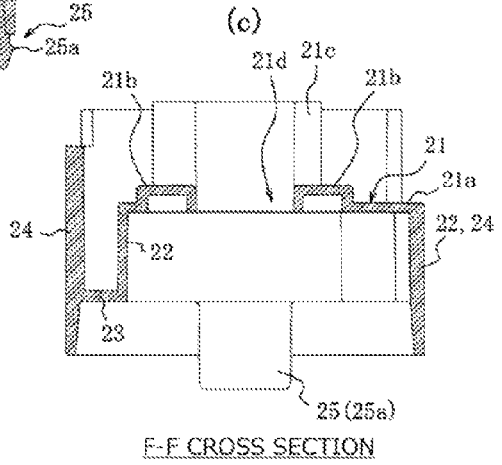
Figure 6:
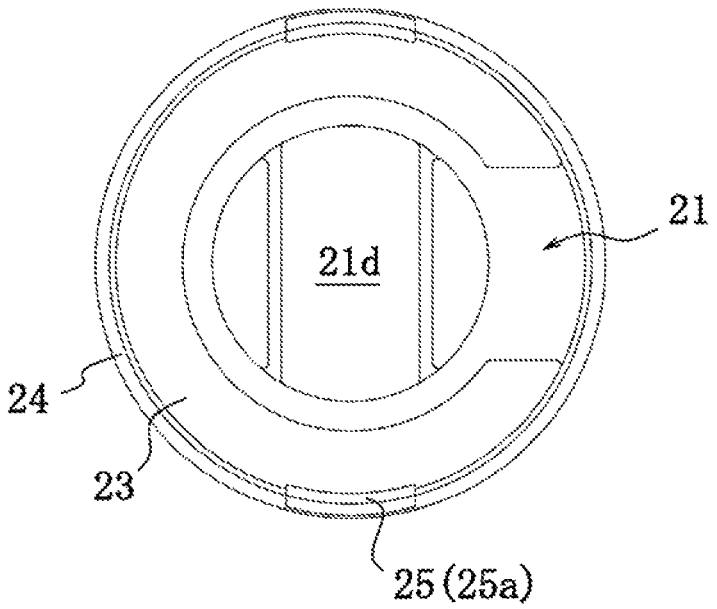
FIG. 6(*a*) is a bottom view and FIG. 6(*b*) is a view seen from the direction of arrow G of FIG. 5(*a*) of the lower cover shown in FIGS. 1(*a*) and 1(*b*)
Figure 6:
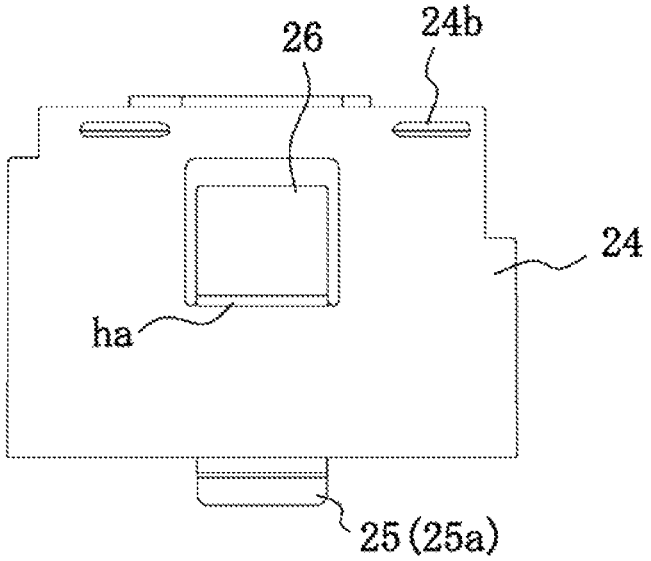
Figure 7:
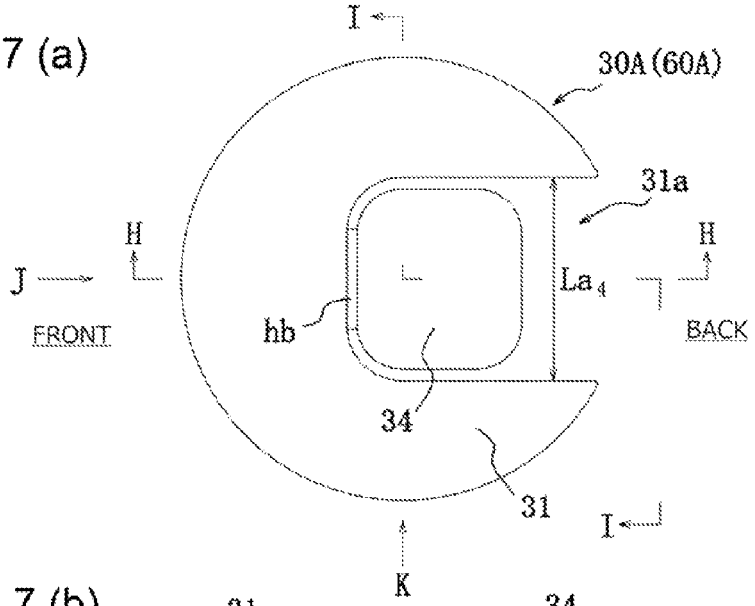
FIG. 7(*a*) is a plan view, FIG. 7(*b*) is a cross-sectional view along H-H of FIG. 7(*a*), and FIG. 7(*c*) is a half cross-sectional view along I-I of FIG. 7(*a*) of the upper cover shown in FIGS. 1(*a*) and 1(*b*)
Figure 7:
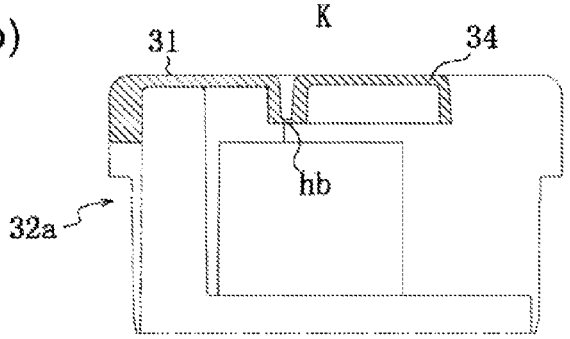
Figure 7:
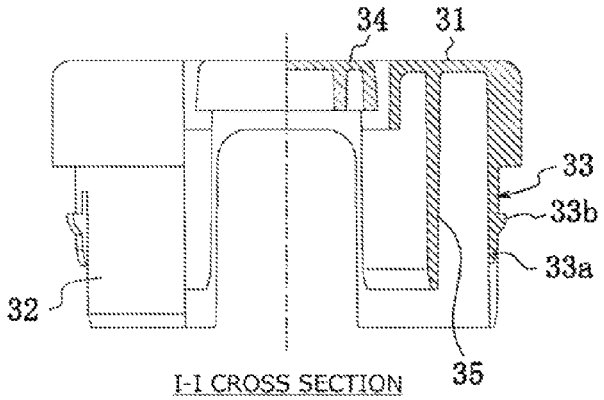
Figure 8:
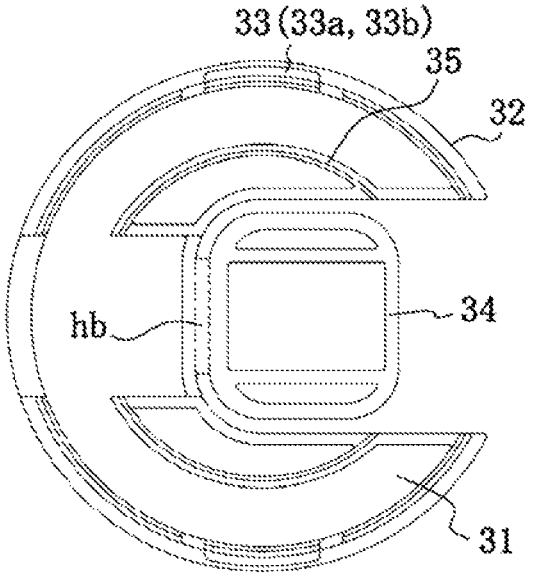
FIG. 8(*a*) is a bottom view, FIG. 8(*b*) is a view seen from the direction of arrow J of FIG. 7(*a*), and FIG. 8(*c*) is a view seen from the direction of arrow K of FIG. 7(*a*) of the upper cover shown in FIGS. 1(*a*) and 1(*b*)
Figure 8:
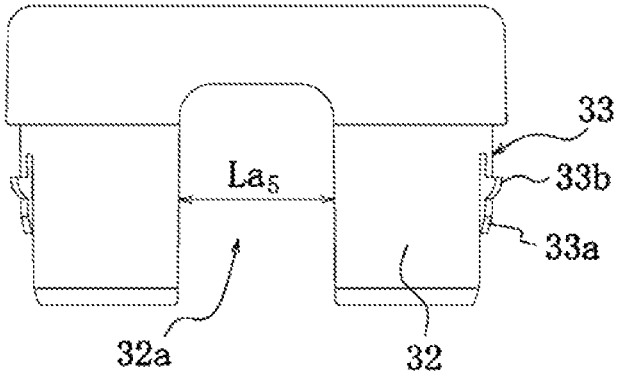
Figure 8:
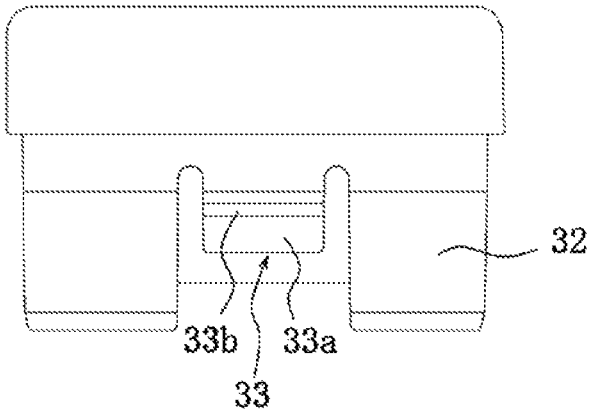
Figure 9:
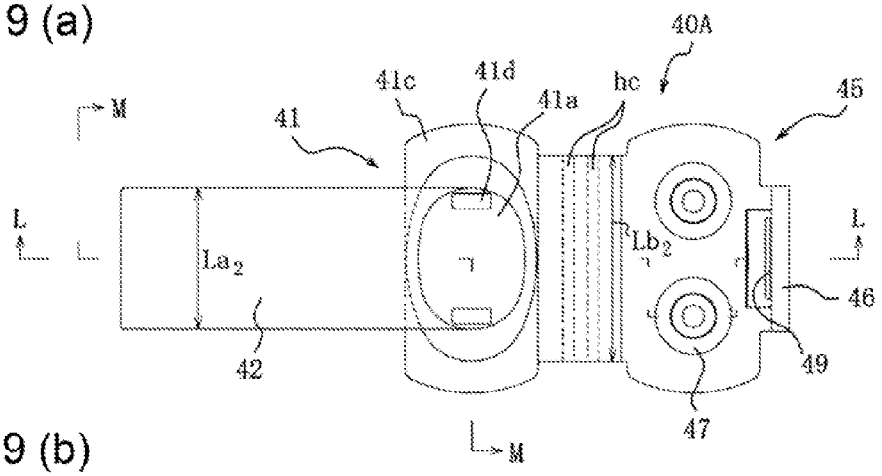
FIG. 9(*a*) is a plan view, FIG. 9(*b*) is a cross-sectional view along L-L of FIG. 9(*a*), FIG. 9(*c*) is a half cross-sectional view along M-M of FIG. 9(*a*), and FIG. 9(*d*) is a bottom view of the nozzle shown in FIGS. 1(*a*) and 1(*b*) before it is bent.
Figure 9:
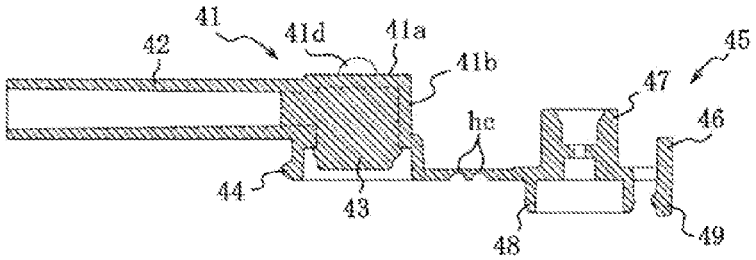
Figure 9:
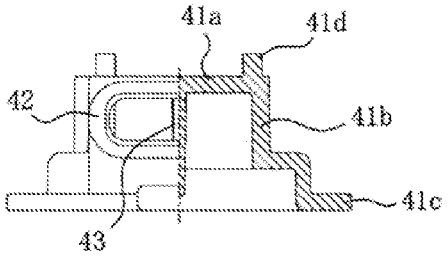
Figure 9:
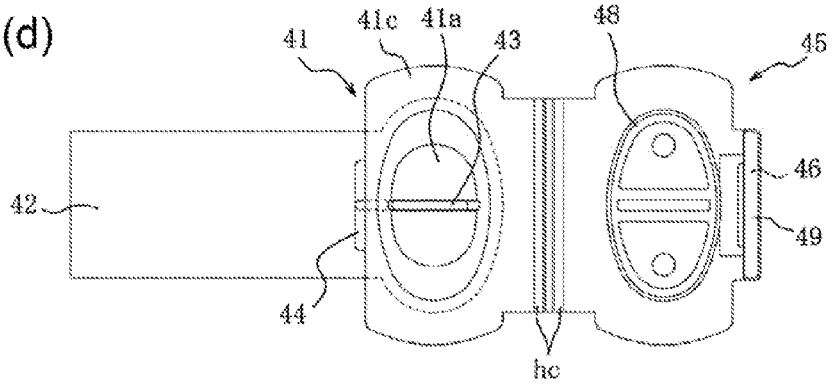
Figure 10:
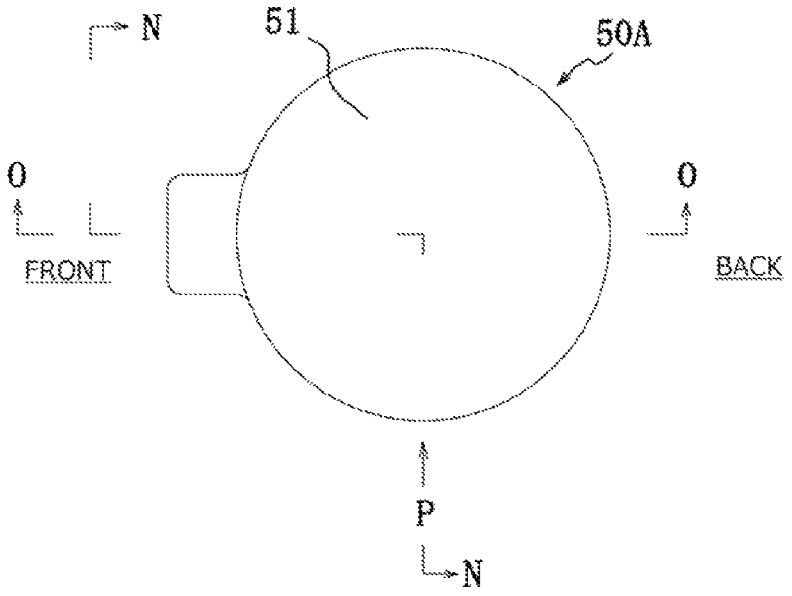
FIG. 10(*a*) is a plan view, FIG. 10(*b*) is a half cross-sectional view along N-N of FIG. 10(*a*), and FIG. 10(*c*) is a cross-sectional view along O-O of FIG. 10(*a*) of the over cap shown in FIG. 2.
Figure 10:
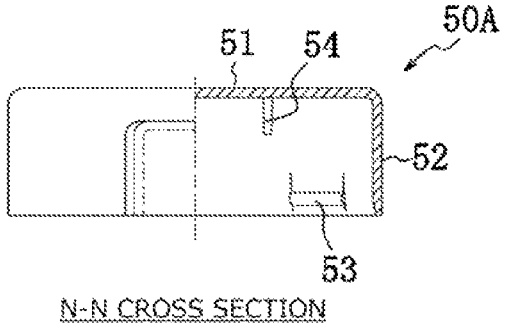
Figure 10:
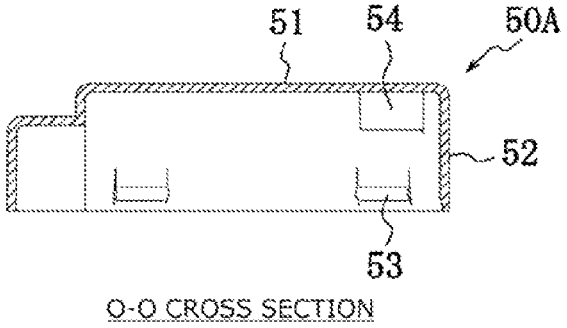
Figure 11:
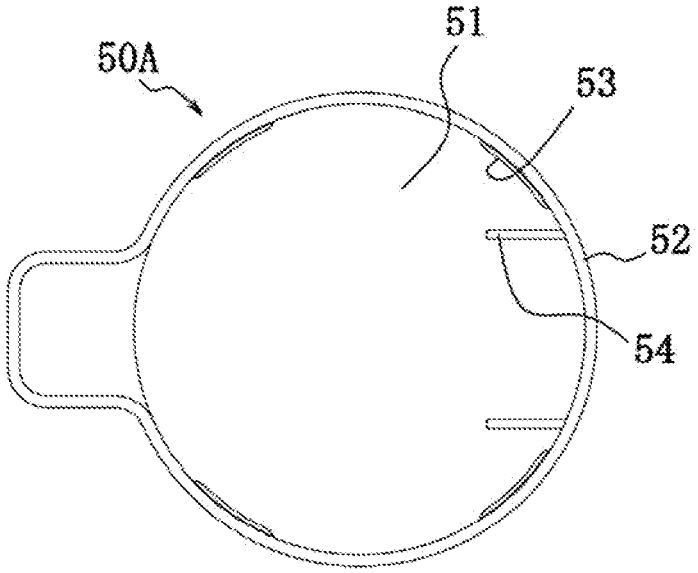
FIG. 11(*a*) is a bottom view and FIG. 11(*b*) is a view seen from the direction of arrow P of FIG. 10(*a*) of the over cap shown in FIG. 2.
Figure 11:
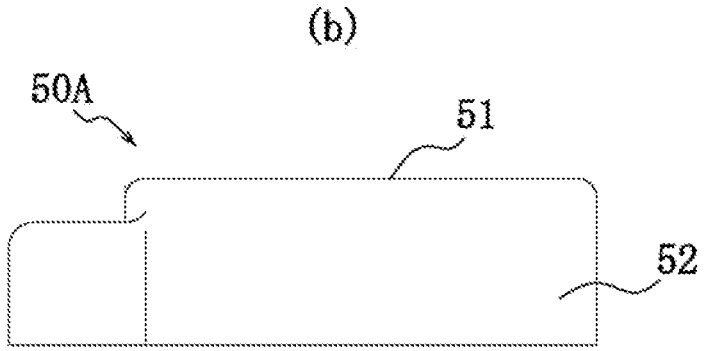

FIG. 1(*a*) is a plan view and FIG. 1(*b*) is a side view illustrating a first embodiment of the fixing plate for an aerosol container according to the present invention in a state in which it is mounted to the container. FIG. 2 is an enlarged cross-sectional view of major parts along A-A shown in FIG. 1(*a*). FIG. 3 is an enlarged half cross-sectional view of major parts along B-B shown in FIG. 1(*a*). FIG. 4(*a*) is a plan view, FIG. 4(*b*) is a half cross-sectional view along C-C of FIG. 4(*a*), FIG. 4(*c*) is a cross-sectional view along D-D of FIG. 4(*a*), and FIG. 4(*d*) is a bottom view of the fixing plate shown in FIG. 1. FIG. 5(*a*) is a plan view, FIG. 5(*b*) is a half cross-sectional view along E-E of FIG. 5(*a*), and FIG. 5(*c*) is a cross-sectional view along F-F of FIG. 5(*a*) of the lower cover shown in FIG. 1. FIG. 6(*a*) is a bottom view and FIG. 6(*b*) is a view seen from the direction of arrow G of FIG. 5(*a*) of the lower cover shown in FIG. 1. FIG. 7(*a*) is a plan view, FIG. 7(*b*) is a cross-sectional view along H-H of FIG. 7(*a*), and FIG. 7(*c*) is a half cross-sectional view along I-I of FIG. 7(*a*) of the upper cover shown in FIG. 1. FIG. 8(*a*) is a bottom view, FIG. 8(*b*) is a view seen from the direction of arrow J of FIG. 7(*a*), and FIG. 8(*c*) is a view seen from the direction of arrow K of FIG. 7(*a*) of the upper cover shown in FIG. 1. FIG. 9(*a*) is a plan view, FIG. 9(*b*) is a cross-sectional view along L-L of FIG. 9(*a*), FIG. 9(*c*) is a half cross-sectional view along M-M of FIG. 9(*a*), and FIG. 9(*d*) is a bottom view of the nozzle shown in FIGS. 1(*a*) and 1(*b*) before it is bent. FIG. 10(*a*) is a plan view, FIG. 10(*b*) is a half cross-sectional view along N-N of FIG. 10(*a*), and FIG. 10(*c*) is a cross-sectional view along O-O of FIG. 10(*a*) of the over cap shown in FIG. 2. FIG. 11(*a*) is a bottom view and FIG. 11(*b*) is a view seen from the direction of arrow P of FIG. 10(*a*) of the over cap shown in FIG. 2.

The "front" herein refers to an outlet side of a discharge tube provided in the nozzle, while the "back (rear)" refers to the opposite side from the front along the axial line of the discharge tube. The "sides" refer to left and right directions when viewing the container from the front to the back.

In FIG. 1 to FIG. 3, reference numeral 10A denotes a first embodiment of the fixing plate for an aerosol container according to the present invention, and reference numeral 2 denotes the aerosol container, to which the fixing plate 10A is mounted. Reference numeral 20A denotes a lower cover, reference numeral 30A denotes an upper cover, reference numeral 40A denotes a nozzle, and reference numeral 50A denotes an over cap (which is not shown in FIG. 1). The lower cover 20A and the upper cover 30A form a cover member 60A.

The aerosol container 2 is formed by fixedly attaching a mounting cup 4 made of metal, for example, to a bottomed cylindrical container body 3 made of metal, for example, by crimping the outer edge of the cup (the crimped portion forming an annular rim 5), as shown in FIG. 2, and contains two types of contents separately inside. The aerosol container 2 includes a total of two stems 6 that lead to housing spaces of respective contents. A projection 7 that is shaped in the form of a race track in plan view binds the two stems 6 and protrudes in the center of the mounting cup 4. The projection 7 may be rectangular or elliptical in plan view.

The fixing plate 10A includes an outer wall 12 that overlaps the mounting cup 4 except in an opening 11 for exposing the two stems 6, and that abuts on an upper face of the annular rim 5, as shown in FIG. 2 and FIG. 3. The outer wall 12 includes, as shown in FIG. 4(*a*) to FIG. 4(*d*), a cylindrical upper tier part 12*a* with a top that is generally circular in plan view, a middle tier part 12*b* that extends radially outward from the lower end of the upper tier part 12*a* and downward from the outer edge, and a lower tier part 12*c* that extends radially outward from the lower end of the middle tier part 12*b* and downward from the outer edge. The outer wall further includes an inner circumferential wall 12*d* that forms the opening 11 on the inner side thereof, in the center of the upper tier part 12*a*, as shown in FIG. 4(*c*). The opening 11 has a modified rectangular shape with arcuate short sides and linear long sides in plan view as shown in FIG. 4(*a*), the long sides positioned in the front and the back. In this embodiment, the long sides of the opening 11 extend so long that part of the inner circumferential wall 12*d* merges with the circumferential wall of the upper tier part 12*a* (see FIG. 4(*b*)).

As shown in FIG. 4(*c*), at the lower end of the inner circumferential wall 12*d* on the inner circumferential side thereof is provided a positioning wall 13 having an inner circumferential shape in the form of a race track in plan view as shown in FIG. 4(*a*). The inner circumferential shape of the positioning wall 13 conforms to the projection 7 of the aerosol container 2 and a rectangular or elliptical one may be selected corresponding to the shape of the projection 7. (In this embodiment, a total of two) tongues 14 are provided to extend downward from the edges along the long sides of the positioning wall 13. Slit-like concave sections 15 are provided in the upper tier part 12*a*. In this embodiment, two concave sections are formed in the front and one in the back as shown in FIG. 4(*a*), so as to make the number of the concave sections 15 formed in the front different from that of the concave sections 15 formed in the back. There may be more concave sections 15 in the back than in the front (e.g., one in the front and two in the back). As shown in FIG. 4(*c*), the middle tier part 12*b* has a cylindrical wall 16 that extends downward from the backside, with a total of three circumferentially equally spaced claws (engaging claws) 16*a* on the inner circumferential surface of the cylindrical wall 16. Furthermore, a total of two oppositely positioned holes (first engaging holes) 17 are provided at the boundary between the middle tier part 12*b* and lower tier part 12*c* to extend through the front and back thereof as shown in FIG. 4(*a*). At the boundary between the middle tier part 12*b* and lower tier part 12*c* are also provided a plurality of (a total of ten in this embodiment) reinforcing ribs 18*a* having a triangular longitudinal cross-sectional shape as shown in FIG. 4(*c*). On both sides of the first engaging holes 17 are a pair of small ribs (outer face ribs) 18*b* that are lower than the reinforcing ribs 18*a*, as shown in FIG. 4(*b*).

In this embodiment, to enhance the rigidity of the fixing plate 10A, there are provided reinforcing ribs 18*c* (a total of six in this embodiment) that connect the inner face of the circumferential wall of the upper tier part 12*a* and the positioning wall 13, and reinforcing ribs 18*d* (a total of four in this embodiment) that connect the inner face of the circumferential wall of the upper tier part 12*a* and the inner circumferential wall 12*d*, as shown in FIG. 4(*d*).

The lower cover 20A includes a top wall 21 having a shape that is generally disc-like, with part thereof in the back protruding radially outward, in plan view as shown in FIG. 5(*a*) to FIG. 5(*c*) and FIG. 6(*a*) and FIG. 6(*b*) (protruded part itself will be referred to as protruded portion 21*a*), and a circumferential wall 22 connected to the edge of the top wall 21. The lower end of the circumferential wall 22 connects to an outer circumferential wall 24 via a connecting wall 23 that extends horizontally at a lower position than the top wall 21, except in the back. The top wall 21 includes stepped portions 21*b* in the front and the back, and a pair of upper circumferential walls 21*c* on the sides. The top wall 21 further includes a modified rectangular opening 21*d* with arcuate short sides and linear long sides in the center, which is oriented so that the long sides are positioned in the front and the back in plan view.

As shown in FIG. 5(*b*), a pair of first engaging pieces 25 are provided on the sides of the outer circumferential wall 24 to extend downward, the first engaging pieces 25 each having a radially outwardly oriented claw 25*a*. In the middle in the up and down direction on the sides of the outer circumferential wall 24 are provided a pair of pressing portions 26 that are connected to each other via a thin hinge ha. A pair of holes (second engaging holes) 27 are provided, each above each pair of pressing portions, to extend through the front and back of the outer circumferential wall 24. Above the second engaging hole 27 on the inner circumferential surface of the outer circumferential wall 24 is a slope 24*a*. Above the second engaging holes 27 are provided convex sections (cover convex section) 24*b* (a total of four in this embodiment, one each in the front and the back on both sides as shown in FIG. 5(*a*)) to extend laterally from the outer circumferential surface of the outer circumferential wall 24.

The upper cover 30A includes a top wall 31 having a shape that is generally disc-like, with a cut-out portion 31*a* formed by removing part thereof in the back, in plan view as shown in FIG. 7(*a*) to FIG. 7(*c*) and FIG. 8(*a*) and FIG. 8(*b*), and a circumferential wall 32 continuous with the rim of the top wall 31. The circumferential wall 32 includes a cut-out portion 32*a* in the front in the lower part thereof (see FIG. 8(*b*)). The circumferential wall 32 also includes second engaging pieces 33 on both sides, these second engaging pieces 33 each including a radially outwardly oriented claw 33*b*, and a pressure receiving portion 33*a* extending downward from the claw 33*b*. An actuator part 34 is provided in the cut-out portion 31*a* of the top wall 31 such as to be connected via a thin hinge hb as shown in FIG. 7(*a*), for expelling the contents from the nozzle 40 when depressed downward. While the upper face of the actuator part 34 in the illustrated example is positioned generally coplanar with the upper face of the top wall 31, the upper face of the actuator part 34 may be located lower than the upper face of the top wall 31. Alternatively, it may be located higher than the upper face of the top wall 31, to the extent that the nozzle 40 will not be pushed in when the over cap 50 is attached. While the upper face of the actuator part 34 is flat here, it may be curved downward in the center so as to give a good feel on the finger tip. An inner circumferential wall 35 is formed on the backside of the top wall 31, as shown in FIG. 7(*c*).

The nozzle 40A is made up of an upper member 41 and a lower member 45 that are united via a thin hinge hc as shown in FIG. 9(*a*) to FIG. 9(*d*) and the nozzle assumes the form shown in FIG. 2 and FIG. 3 when bent along the hinge hc.

The upper member 41 includes a top wall 41*a* that is elliptical in plan view, a circumferential wall 41*b* continuous with the rim of the top wall 41*a*, and a flange 41*c* extending outward from the lower end on both sides of the circumferential wall 41*b*, as shown in FIG. 9(*a*). A total of two semi-circular ribs 41*d* that are semi-circular in side view are provided on the top wall 41*a*. A discharge tube 42 having a generally rectangular cylindrical cross-sectional shape is integrally connected to the front of the upper member 41. A partition wall 43 is provided to a portion where the upper member 41 and the discharge tube 42 are connected together. A claw 44 is provided to a lower portion of the discharge tube 42.

The lower member 45 is generally planar and has a tab 46 formed in the back thereof as shown in FIG. 9(*b*). On the front side of the lower member 45 are provided a total of two cylindrical connection parts 47, while, on the backside, there are annular walls 48 that form passages R (see FIG. 3) continuous from the connection parts 47 to the outlet of the discharge tube 42 together with the circumferential wall 41*b* when the nozzle is folded over, and a claw 49 that engages the claw 44 to maintain the folded-over shape.

The over cap 50A includes a top wall 51 that is generally disc-like, with part thereof in the front being stepped and protruding radially outward, in plan view as shown in FIG. 10(*a*) to FIG. 10(*c*) and FIG. 11(*a*) and FIG. 11(*b*), and a circumferential wall 52 continuous with the rim of the top wall 51. On the inner circumferential surface of the circumferential wall 52 are radially inwardly protruding convex sections (cap convex sections) 53 (a total of four in this embodiment, one each in the front and the back on both sides), and a pair of positioning ribs 54 spaced apart in the back.

Next, the process of mounting these fixing plate 10A, lower cover 20A, upper cover 30A, nozzle 40A, and over cap 50A to the aerosol container 2 will be described with reference to FIG. 2 and FIG. 3.

First, the fixing plate 10A is mounted to the mounting cup 4. Here, if the race-track shape of the positioning wall 13 shown in FIG. 4(*a*) is aligned with the projection 7 of the aerosol container 2, the fixing plate 10A will be lowered to a height where the tips of the tongues 14 abut on the lower end of the projection 7. If, however, they are misaligned with each other, the fixing plate 10A will be located higher than the predetermined height because the tips of the tongues 14 abut on the upper face of the projection 7. Namely, whether they are aligned with each other or not can be determined based on the difference in height of the fixing plate 10A, so that the assembling work is made easier. As the fixing plate 10A is rotated and when the positioning wall and the projection are aligned with each other, the fixing plate 10A moves downward, so that the completion of positioning can be recognized by tactile sensation. The fixing plate 10A may be pushed in afterwards, which will cause the tongues 14 to bend outward as shown in FIG. 2 and allow the engaging claws 16*a* to engage the annular rim 5.

Next, with the first engaging pieces 25 of the lower cover 20A being aligned with the first engaging holes 17 of the fixing plate 10A, the lower cover 20A is pressed into the fixing plate 10A to joint them together.

Then, the connection parts 47 of the nozzle 40A, which is folded over from the form shown in FIG. 9 into the form shown in FIG. 2 and FIG. 3, are fitted to the stems 6 of the aerosol container 2, with the discharge tube 42 oriented to the front. Here, the nozzle 40A is located inside of the upper circumferential wall 21*c* of the lower cover 20A as shown in FIG. 3. The upper circumferential wall 21*c* has a smaller width ($La_1$) on the front side than the width ($Lb_1$) on the back side as shown in FIG. 5(*a*). Similarly, the nozzle 40A has a smaller width ($La_2$) on the front side than the width ($Lb_2$) on the back side as shown in FIG. 9(*a*). Since they are formed to satisfy a relationship of $Lb_2>La_1$, a backward attachment of the nozzle 40A can be prevented reliably.

After that, with the second engaging pieces 33 of the upper cover 30A being aligned with the second engaging holes 27 of the lower cover 20A, the upper cover 30A is pressed into the lower cover 20A to joint them together. Here, the width ($La_4$) of the cut-out portion 31*a* of the upper cover 30A shown in FIG. 7(*a*) is wider than the width ($La_3$) of the protruded portion 21*a* of the lower cover 20A shown in FIG. 5(*a*), while the width ($La_5$) of the cut-out portion 32*a* shown in FIG. 8(*b*) is narrower than $La_3$ ($La_4>La_3>La_5$). Therefore, if an attempt is made to attach the upper cover 30A backwards, the circumferential wall 32 of the upper cover 30A abuts on the protruded portion 21*a* of the lower cover 20A and prevents the attachment, so that the upper cover can be attached in the intended orientation reliably. In this embodiment, also, the slopes 24*a* provided above the second engaging holes 27 as shown in FIG. 3 allow the second engaging pieces 33 to smoothly bend flexibly radially inward as they are inserted, which enables attachment with even a smaller pressing force. When mounting the upper cover 30A, the inner circumferential wall 35 may be contacted along the upper circumferential wall 21*c* of the lower cover 20A, so that the inner circumferential wall 35 and the upper circumferential wall 21*c* can function as a guide when mounting the upper cover.

After that, the over cap 50A is attached on the upper cover 30A. As the cap convex sections 53 of the over cap 50A engage the cover convex sections 24*b* of the lower cover 20A as shown in FIG. 3, and as the positioning ribs 54 formed on the backside of the over cap 50A fit in the cut-out portion 31*a* of the top wall 31 of the upper cover 30A, the over cap 50A is held in the predetermined position. Since the cover convex sections 24*b* and cap convex sections 53 are formed one each in the front and the back on both sides as mentioned above, the over cap 50A is prevented from tilting forward, backward, or sideward and held more stably. The cover convex sections may be formed on the upper cover 30A.

To attach the fixing plate 10A and others to the aerosol container 2, the lower cover 20A, nozzle 40A, upper cover 30A, and over cap 50A may be successively attached to the fixing plate 10A in advance, and these may then be mounted to the aerosol container 2. Alternatively, the fixing plate 10A, lower cover, nozzle, and upper cover 30A may be assembled together first, and then attached to the aerosol container 2, after which the over cap 50A may be mounted.

To expel the contents from the aerosol container 2 to which various parts have been mounted as described above, the over cap 50A is first removed. Then the actuator part 34 of the upper cover 30A is pressed downward, so that the actuator part 34 abuts on the semi-circular ribs 41*d* of the nozzle 40A, whereby the stems 6 connected to the nozzle 40A are pressed down. This way, the two types of contents are ejected simultaneously from the respective stems 6, and expelled through the passages R formed inside the nozzle 40A and from the outlet of the discharge tube 42. In this embodiment, the partition wall 43 provided inside the nozzle 40A divides only the upstream side of the passage R into two sections (the upstream side of the passage R being the side closer to the stems 6, while the downstream side being the side closer to the outlet of the discharge tube). Depending on the types of the contents, however, the partition wall 43 may be extended to near the outlet of the discharge tube 42 to divide the passage R generally entirely (so that two passage portions are formed inside one discharge tube 42), or, may be made shorter on the upstream side so that a smaller area is divided than in this embodiment, or, the partition wall 43 may be removed so that no area is divided.

Any remnant contents inside the passage R may dry up and clog the passage. In this embodiment, the upper cover 30A can be removed by pressing in the pressing portions 26 of the lower cover 20A radially inward, whereupon the backside of each pressing portion 26 abuts on the pressure receiving portion 33*a* of the upper cover 30A as shown in FIG. 3 and allows the second engaging pieces 33 of the upper cover 30A and the second engaging holes 27 of the lower cover 20A to be released from engagement. After that, by pulling up the nozzle 40A to remove it from the stems 6 as shown in FIG. 2, and by tilting the tab 46 toward the connection parts 47 to disengage the claw 44 from the claw 49, the nozzle 40A can be opened up, so that the inside of the nozzle 40A can be cleaned with ease. The tab 46 is not limited to the illustrated form and may be of any shape as long as it lets the finger to take hold of the nozzle 40A when it is to be opened.

Next, another form of embodiment will be described with reference to FIG. 12 to FIG. 14, in which different types of cover member, nozzle, and over cap from those of the previously described embodiment, are mounted. Parts that are common to those of the configuration described above are given the same reference numerals and will not be described again.

The cover member 60B generally has the functions of the lower cover 20A and the upper cover 30A united together, and includes a dome-like circumferential wall 61B with a cut-out portion in the back and an actuator part 62B provided in this cut-out portion via a hinge hd. Inside the circumferential wall 61B is a middle wall 63B extending horizontally and abutting on the upper face of the upper tier part 12*a* of the fixing plate 10A. The middle wall 63B has an opening in the center for the stems 6 to pass through. On the underside of the middle wall 63B are plate-like convex sections 64B that fit into slit-like concave sections 15 formed in the fixing plate 10A when attaching the cover member 60B to the fixing plate 10A, as shown in FIG. 12. In this embodiment, two convex sections are formed in the front and one convex section is formed in the back, corresponding to the concave sections 15. The front to back orientation of the cover member 60B can thus be recognized by the difference in the number of the convex sections 64B, and a backward attachment of the cover member 60B can be prevented. The concave sections 15 and the convex sections 64B are interchangeable, i.e., the convex sections may be formed on the fixing plate 10A, and the concave sections may be formed in the cover member 60B. As shown in FIG. 13, a pair of first engaging pieces 65B are provided on the circumferential wall 61B to extend downward, the first engaging pieces 65B each having a radially outwardly oriented claw $\mathbf{65}B_1$. Since the first engaging pieces 65B are separated from the circumferential wall 61B by slits 66B extending in the up and down direction on both sides as shown in FIG. 14 and flexibly bend inwards when pressed from the outer side, the cover member 60B can be removed from the fixing plate 10A.

Figure 14:
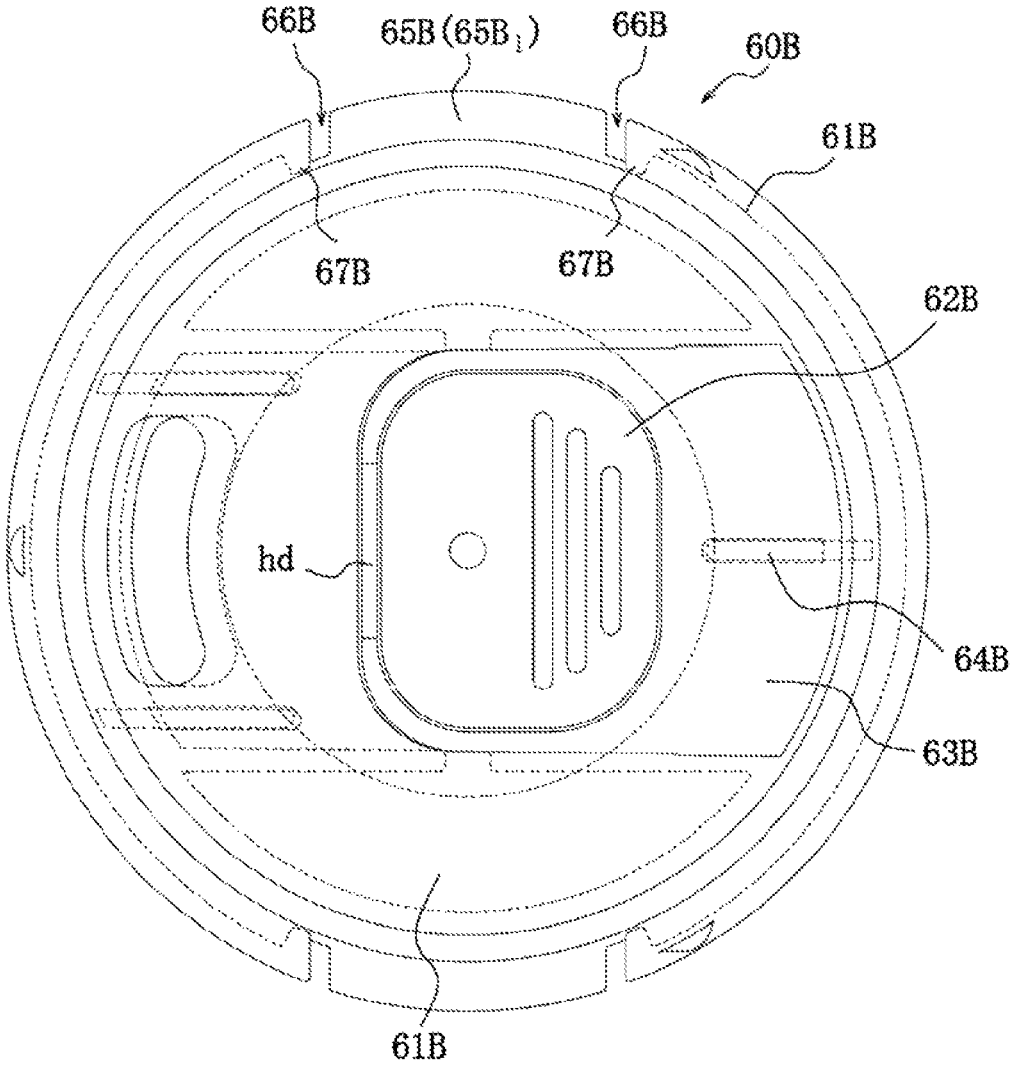
FIG. 14 is a plan view of the cover member shown in FIG. 12.

On the inner face of the circumferential wall 61B on both sides of the first engaging pieces 65B are a pair of inner face ribs 67B as shown in FIG. 14. The pairs of inner face ribs 67B are each located between the pairs of outer face ribs 18*b* on the fixing plate 10A (see FIG. 4(*a*)). Therefore, when the first engaging pieces 65B are pressed in, the inner face ribs 67B on the circumferential wall 61B abutting on the outer face ribs 18*b* prevent the circumferential wall 61B from deforming outwardly in a collapsing manner, so that the cover member 60B can be removed easily.

Figure 12:
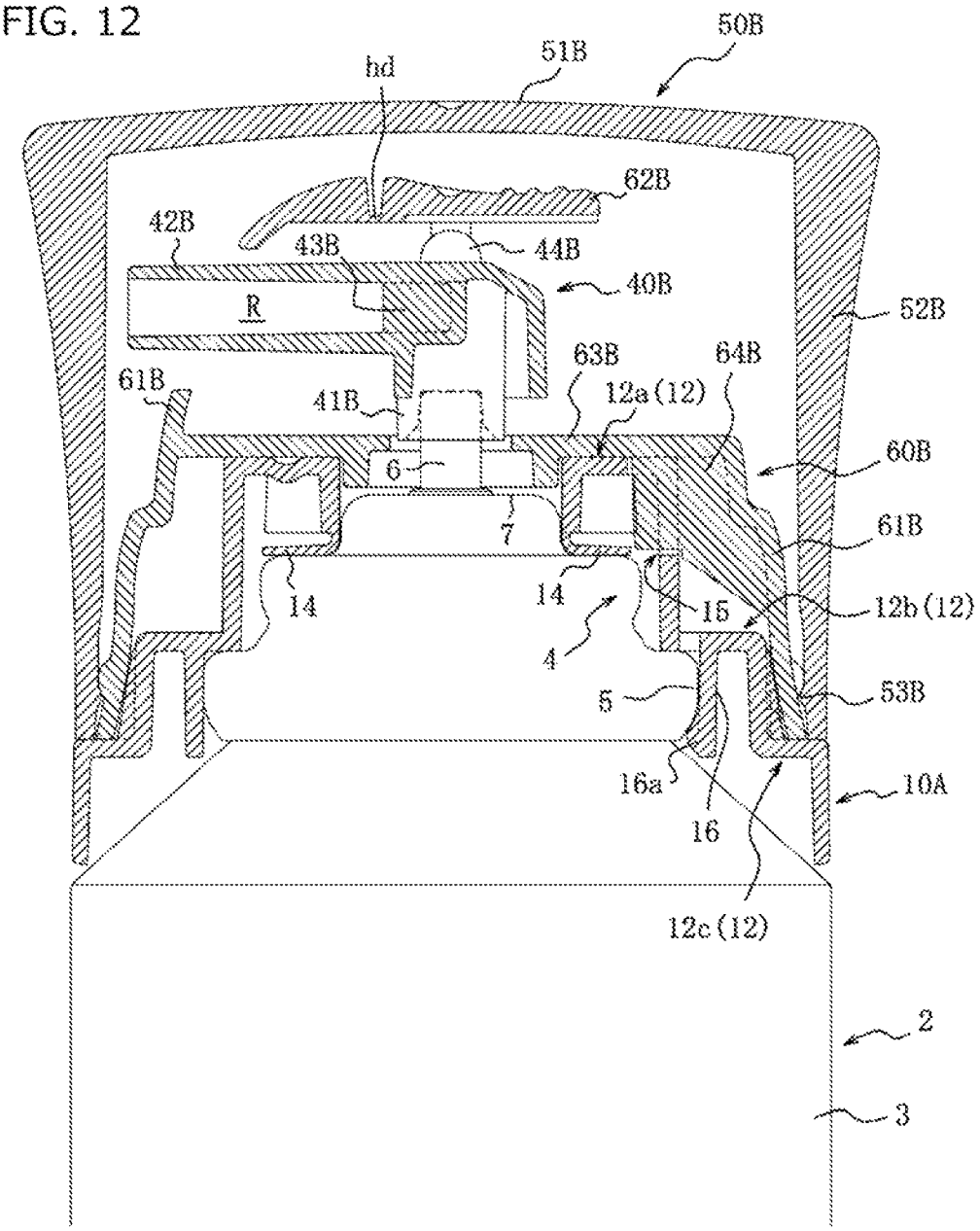
FIG. 12 is an enlarged cross-sectional view of major parts illustrating, in accordance with FIG. 2, different types of cover member, nozzle, and over cap mounted in the state of FIG. 2.
Figure 13:
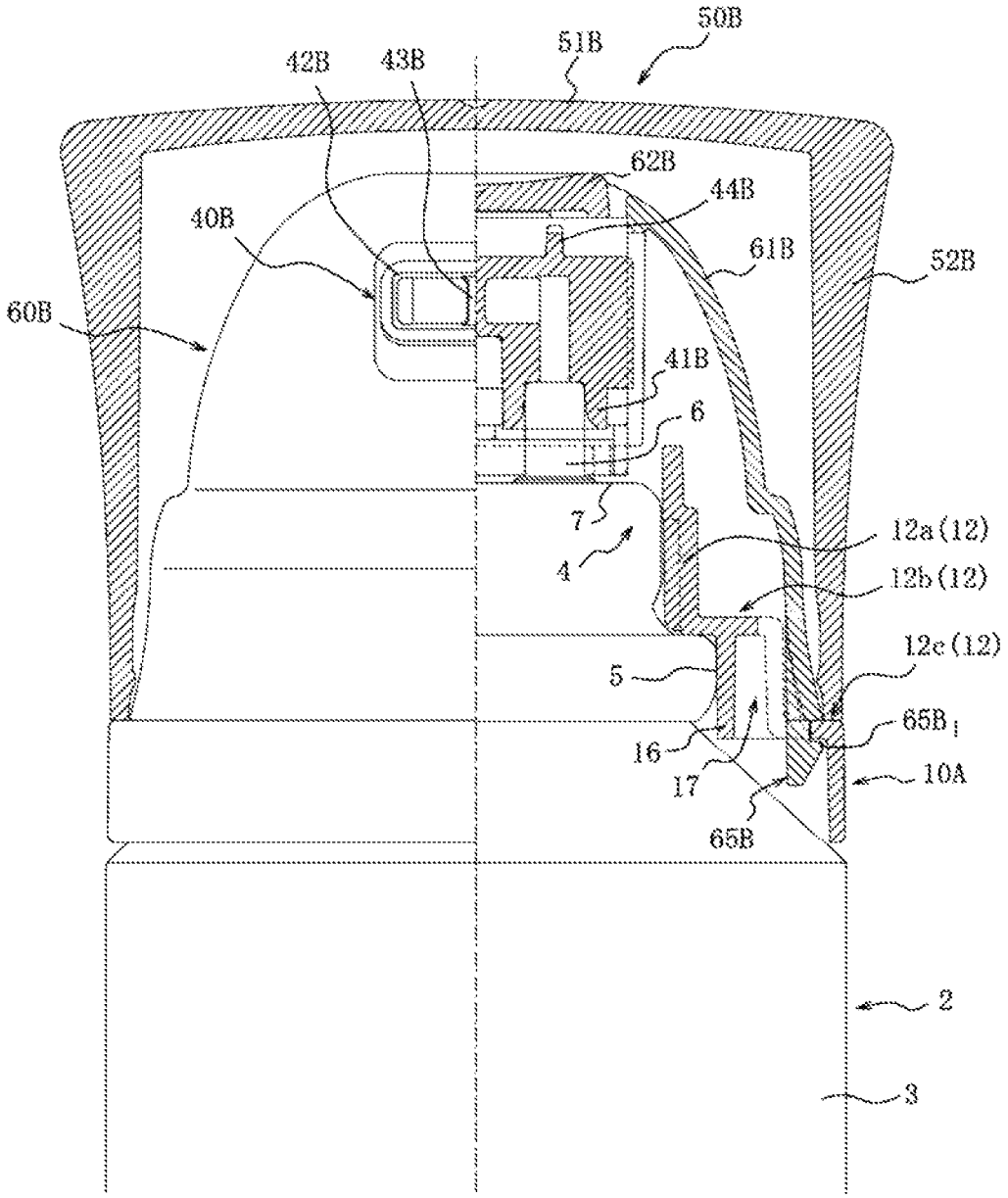
FIG. 13 is an enlarged half cross-sectional view illustrating the state of FIG. 12 in accordance with FIG. 3.

The nozzle 40B is generally the nozzle 40A without the opening/closing function, and includes two connection parts 41B that lead to the stems 6 and are integrally connected to the single discharge tube 42B which is the outlet of the contents, with a passage R of the contents formed inside, as shown in FIG. 12 and FIG. 13. A partition wall 43B is provided in the passage R. Semi-circular ribs 44B, for the actuator part 62B to abut on to expel the contents, are provided on the top of the nozzle 40A.

The over cap 50B has a disc-like top wall 51B and an outer circumferential wall 52B integrally connected to the outer edge of the top wall and having an outer contour with a downwardly gradually decreasing diameter, and accommodates the discharge tube 42B of the nozzle 40B inside. Thus, dust or the like hardly adheres on the discharge tube 42B.

Figure 15:
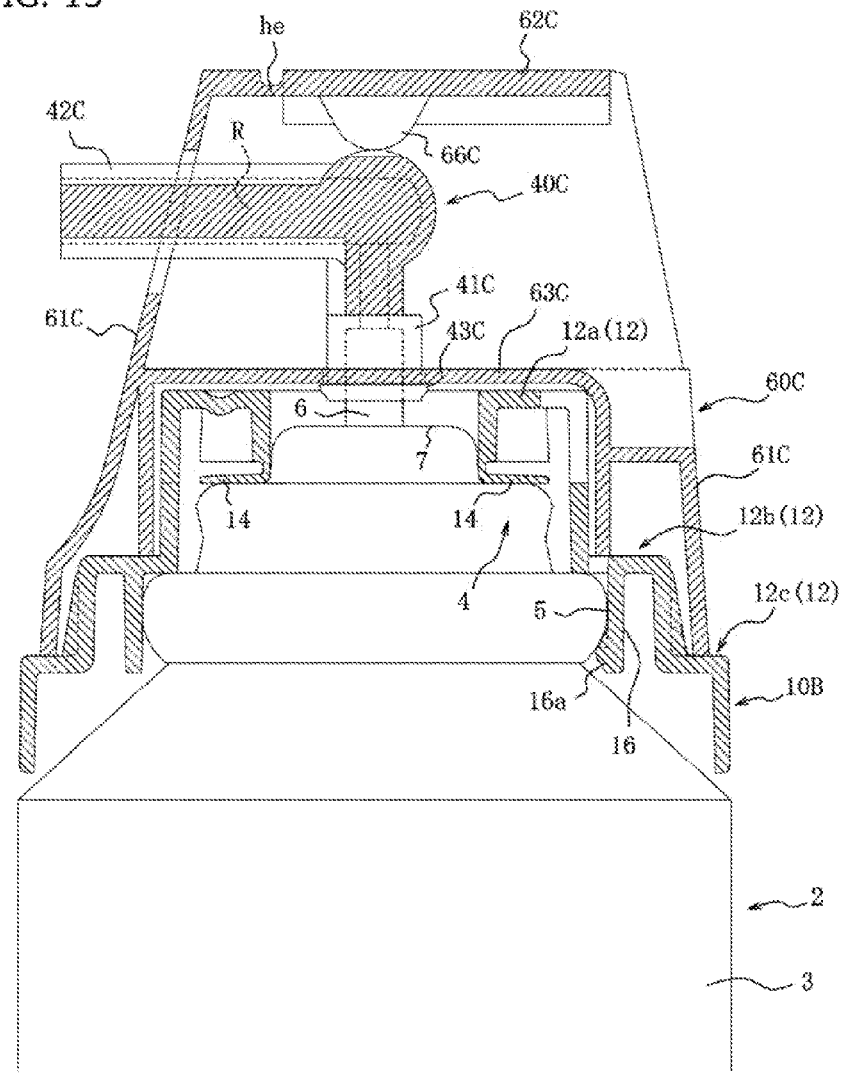
FIG. 15 is an enlarged cross-sectional view of major parts illustrating, in accordance with FIG. 2, a second embodiment of the fixing plate for an aerosol container according to the present invention, with different types of cover member and nozzle mounted in the state of FIG. 2.

Next, the second embodiment of the fixing plate for an aerosol container according to the present invention will be described with reference to FIG. 15 and FIG. 16.

Figure 16:
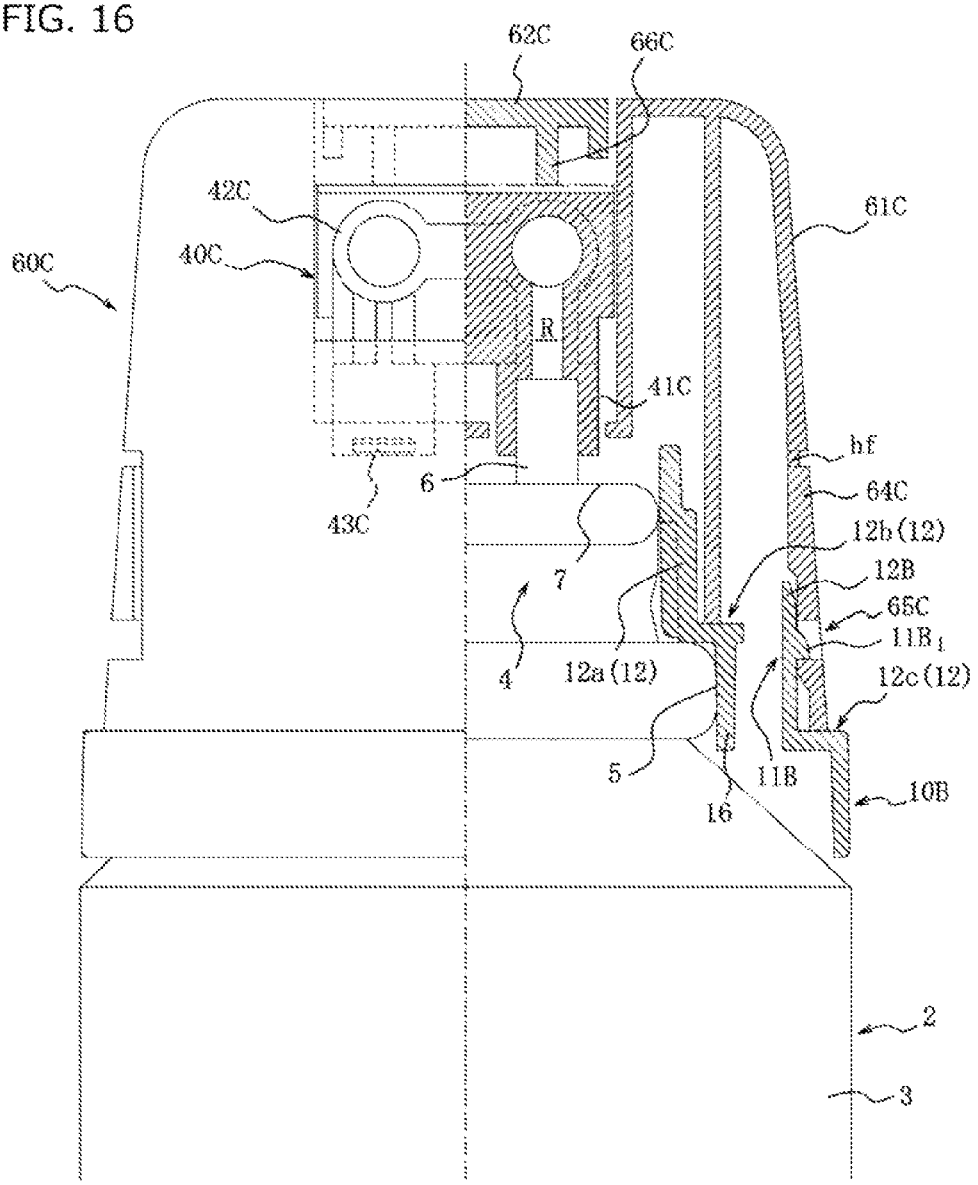
FIG. 16 is an enlarged half cross-sectional view illustrating the state of FIG. 15 in accordance with FIG. 3.

The fixing plate 10B has generally the same shape as the fixing plate 10A, but includes, as shown in FIG. 16, engaging pieces 11B that are formed to flexibly bend inward on the outer face of the circumferential wall of the middle tier part 12*b*. The engaging pieces 11B each include a radially outwardly oriented claw 11$B_1$, and a pressure receiving portion 12B with an upwardly extending tip.

The cover member 60C generally has the functions of the lower cover 20A and the upper cover 30A united together similarly to the cover member 60B, and includes a frustum-shaped circumferential wall 61C with a cut-out portion in the back and an actuator part 62C provided in this cut-out portion via a hinge he. Inside the circumferential wall 61C is an inner wall 63C that overlaps the upper tier part 12*a* of the fixing plate 10B. The inner wall 63C has an opening in the center for the stems 6 to pass through. As shown in FIG. 16, pressing portions 64C are formed via hinges hf on the sides of the circumferential wall 61C, and engaging holes 65C are formed below the pressing portions 64C for the claws 11$B_1$ of the engaging pieces 11B to engage. Thereby, while the cover member 60C is anchored to the fixing plate 10B, it can be removed by pressing the pressing portions 64C inward, whereupon the pressing portions press the pressure receiving portions 12B on the backside and release the claws 11$B_1$ of the engaging pieces 11B from engagement with the engaging holes 65C.

The nozzle 40C has two connection parts 41C that lead to the stems 6, and two discharge tubes 42C integrally connected to respective connection parts, with passages R for the contents formed independently of each other inside (a total of two passages R). Claws 43C are provided at the lower ends of the connection parts 41C, which engage the edge of the opening in the inner wall 63C to anchor the nozzle 40C to the cover member 60C. Ribs 66C with a rounded top are provided on the backside of the actuator part 62C mentioned above, so that, when the actuator part 62C is pressed, the ribs 66C abut on the upper face of the nozzle 40C, whereby the contents are expelled simultaneously from the respective stems 6.

Next, the third embodiment of the fixing plate according to the present invention will be described with reference to FIG. 17 and FIG. 18.

Figure 17:
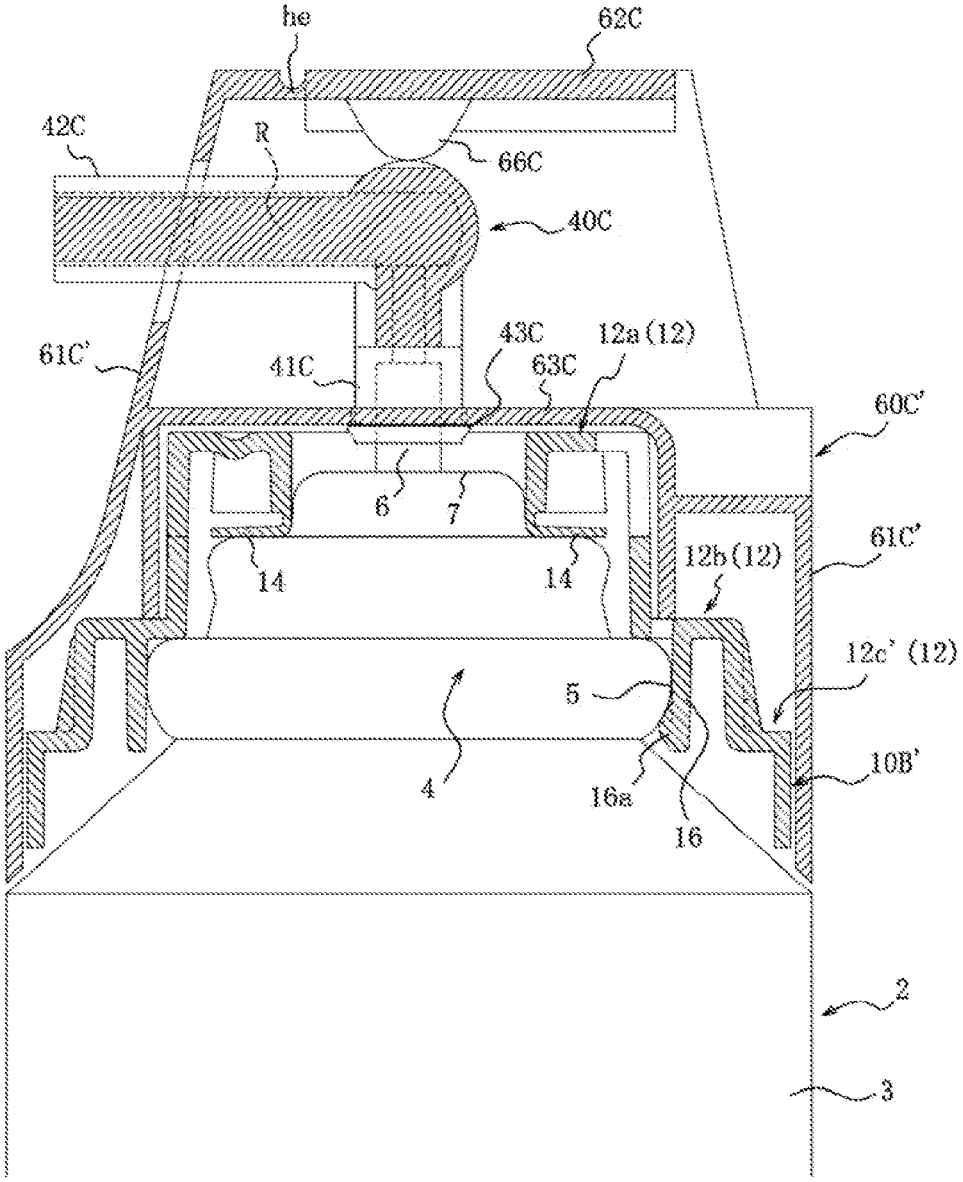
FIG. 17 is an enlarged cross-sectional view of major parts illustrating, in accordance with FIG. 2, a third embodiment of the fixing plate for an aerosol container according to the present invention, with different types of cover member and nozzle mounted in the state of FIG. 2.
Figure 18:
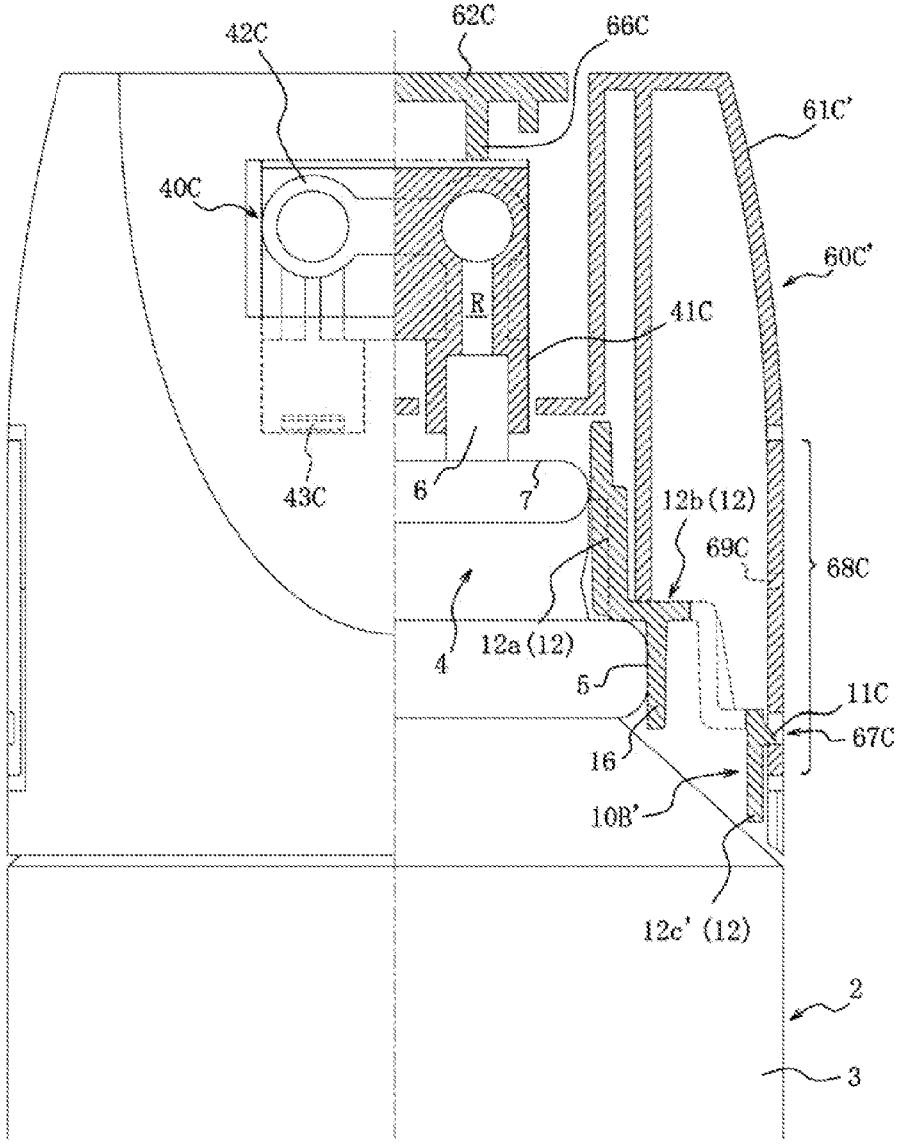
FIG. 18 is an enlarged half cross-sectional view illustrating the state of FIG. 17 in accordance with FIG. 3.

The fixing plate 10B' has generally the same shape as the fixing plate 10B, but, as shown in FIG. 17, the circumferential wall of the lower tier part 12*c*' is located radially more inward than the outer circumferential surface of the aerosol container 2, and includes, as shown in FIG. 18, outwardly oriented claws 11C.

The cover member 60C' has generally the same shape as the cover member 60C, but, as shown in FIG. 17, the circumferential wall 61C' has an outer shape with substantially the same diameter as the outer circumferential surface of the aerosol container 2 and accommodates the lower tier part 12*c*' of the fixing plate 10B' inside. Thus, the fixing plate 10B' is entirely covered by the cover member 60C', so that the fixing plate 10B' does not need to be provided with any special decorative effect. On the side face of the circumferential wall 61C' are pivoting pieces 68C each formed with an engaging hole 67C to engage the claws 11C as shown in FIG. 18. The pivoting pieces 68C are connected to the circumferential wall 61C' in the front and the back by connecting pieces 69C indicated with broken lines in the drawing. Pressing upper regions of the pivoting pieces 68C above the connecting pieces 69C inward turns the pivoting pieces 68C around the connecting pieces 69C, whereby the engaging holes 67C move outward and are released from engagement with the claws 11C.

The fixing plate according to the present invention can be adopted to various cover members without changing its major parts, so that the development efficiency is improved and the cost is reduced.

INDUSTRIAL APPLICABILITY

According to the present invention, a novel fixing plate for an aerosol container, which can be mounted to an aerosol container with two stems reliably and easily, and allows attachment of various cover members, is provided.

The invention claimed is:

1. A fixing plate for an aerosol container, mounted to an aerosol container having two stems in one container to engage and hold a cover member covering a mounting cup of the container, the fixing plate comprising:

an outer wall that covers said mounting cup except an opening exposing said two stems and abuts on an upper face of an annular rim of the mounting cup;

a cylindrical wall integrally connected to the outer wall on a lower side thereof and surrounding the annular rim; and an engaging claw provided on an inner circumferential surface of the cylindrical wall to engage with the annular rim thereby anchoring the fixing plate, wherein the outer wall includes a positioning wall having an inner circumferential shape following an outer circumferential surface of a projection that protrudes from said mounting cup, with said two stems being bound together, and that has a non-circular cross-sectional shape with long sides and short sides.

2. The fixing plate for an aerosol container according to claim 1, wherein the inner circumferential shape of said positioning wall has a rectangular, race-track, or elliptical shape.

3. The fixing plate for an aerosol container according to claim 2, wherein said positioning wall is provided with thin tongues that extend downward from long side edges thereof.

4. The fixing plate for an aerosol container according to claim 1, wherein said outer wall includes a pair of outer face ribs at positions sandwiching a pair of inner face ribs, which are provided on both sides of an engaging piece of said cover member.

5. The fixing plate for an aerosol container according to claim 1, wherein said outer wall includes a concave section or a convex section to be fitted with at least one convex section or one concave section provided in the cover member, used for attaching said cover member.

6. The fixing plate for an aerosol container according to claim 5, wherein the concave section or convex section of said outer wall is provided in a front portion and a rear portion of the outer wall corresponding to the convex section or concave section of said cover member, and wherein the number of the concave section or convex section provided in the front portion is different from that of the concave section or convex section provided in the rear portion.

* * * * *